United States Patent [19]

O'ffill

[11] 4,260,371

[45] Apr. 7, 1981

[54] MODULAR HEAT EXCHANGE APPARATUS

[75] Inventor: Joseph M. O'ffill, Shawnee Mission, Kans.

[73] Assignee: Shale Oil Science & Systems, Inc., Kansas City, Mo.

[21] Appl. No.: 59,230

[22] Filed: Jul. 20, 1979

[51] Int. Cl.[3] ..... F27D 13/00; F27D 15/02

[52] U.S. Cl. ..... 432/82; 165/107 R; 432/121; 432/139; 198/561; 198/822; 198/952; 414/152; 414/157

[58] Field of Search ..... 165/107, DIG. 12; 432/82, 121, 139; 198/952, 822, 561; 414/152, 157

[56] References Cited

U.S. PATENT DOCUMENTS

| | | | |
|---|---|---|---|
| 699,278 | 5/1902 | Zwoyer | 198/822 |
| 1,077,918 | 11/1913 | Seck | 198/822 |
| 1,544,624 | 7/1925 | Arango | 432/139 |
| 1,867,772 | 7/1932 | Smalley | 432/82 |
| 1,938,581 | 12/1933 | Cope et al. | 432/82 |
| 2,093,061 | 9/1937 | Wallace | 432/82 |

*Primary Examiner*—Albert W. Davis

*Attorney, Agent, or Firm*—Schmidt, Johnson, Hovey & Williams

[57] ABSTRACT

Modular, conveyor-type heat exchange apparatus is provided which is especially adapted for handling large volumes of shale rock and preheating incoming raw shale using hot, spent shale from a commercial processing operation. The apparatus includes an elongated heat exchange zone having a plurality of separate, interconnected, insulated modules; two superposed, oppositely moving sections of an endless conveyor pass through the zone and respectively support hot and raw shale material for heat exchange therebetween. The conveyor includes spaced, interconnected, shale-supporting triangular elements which facilitate gas flow between the conveyor sections in the heat exchange zone. In preferred forms, the modules present restricted inlet and outlet throats, and are provided with slow moving fans for circulation of air currents between the conveyor sections without creation of chimney-like drafts along the length of the modules.

9 Claims, 8 Drawing Figures

MODULAR HEAT EXCHANGE APPARATUS

BACKGROUND OF THE INVENTION

1. Field of the Invention

The present invention is concerned with an improved conveyor-type modular heat exchange apparatus especially designed for use in commercial scale plants employing the methods described in U.S. Pat. No. 4,088,562. More particularly, it is concerned with such apparatus which includes a heat exchange zone formed of easily replaced and/or repaired, restricted-throat interconnected modules, and an improved shale-supporting endless conveyor which is oriented such that two oppositely moving stretches thereof pass through the heat exchange zone and respectively support hot spent shale and raw shale, so as to preheat the latter prior to full processing thereof.

2. Description of the Prior Art

U.S. Pat. No. 4,088,562 represents a major breakthrough in the art of hydrocarbon recovery from oil shale. As disclosed in that patent, raw, incoming shale to the process is preheated in a heat exchange zone or tunnel, using the hot, spent oil shale from the process.

It will of course be appreciated that use of the hot, spent shale as a source of heat for the raw, incoming shale greatly lowers the total heat input for the process and improves the overall energy efficiency thereof. However, in order to be truly effective, an efficient heat exchange device must be provided. A prime difficulty in this connection is that, on a commercial scale, extremely large quantities of shale must be routinely handled. Thus, the exchanger apparatus must be extremely strong and durable. At the same time, in order to avoid costly down times, the apparatus should be susceptible to quick and easy repair and/or replacement.

As an adjunct to the foregoing, it is also of course necessary to convey the raw shale from a mine or other pickup site, and to correspondingly convey the spent shale to a disposal area. The conveyor device used in this connection must likewise be of simple, durable construction, in order to meet the dictates of commercial operation.

Prior heat exchanger and conveyor devices are illustrated in U.S. Pat. Nos. 2,218,935, 2,157,321, 1,992,704, 2,411,179, 3,431,657, 2,775,823, 614,847, 449,464, 3,339,712, and 1,374,874.

SUMMARY OF THE INVENTION

The present invention provides greatly improved heat exchanger/conveyor apparatus which is especially designed for use in the processes described in U.S. Pat. No. 4,088,562. To this end, the heat exchange zone of the overall apparatus includes a plurality of separate, interconnected modules of fiberglass or like material which cooperatively present an elongated heat exchange zone. The respective modules present restricted openings or throats at the opposed ends thereof for minimizing chimney-like airflow or drafts between modules.

Preferably, spaced, adjacent, superposed, oppositely moving sections of an endless conveyor pass through the interconnected modules and respectively support cold, raw shale and hot, spent shale. Outside of the heat exchange zone, the preheated raw shale is passed to the processing area, whereas spent, cooled shale is directed to a disposal area.

The preferred conveyor of the invention is endless and includes a plurality of spaced, juxtaposed, transversely extending shale-supporting elements which are triangular in cross-section. The respective elements are interconnected by means of side plates which extend both above and below the elements and serve to confine the oil shale. The endless conveyor is supported for travel along a defined path, at least a portion of which results in passage of oppositely moving sections of the conveyor through the above-described modular heat exchange zone.

DESCRIPTION OF THE PREFERRED EMBODIMENT

Figure 1:
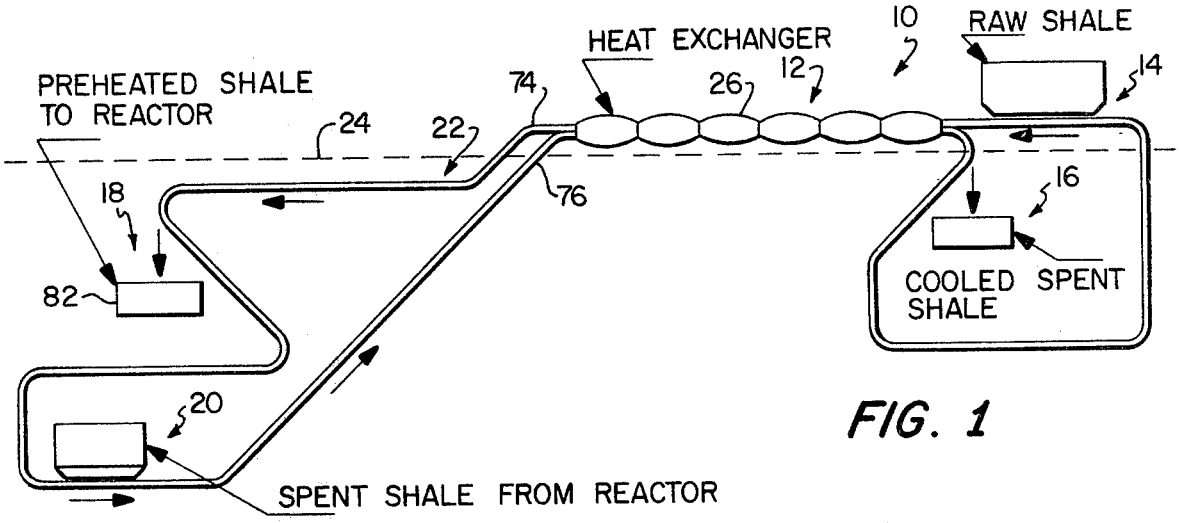
FIG. 1 is a schematic representation of the overall conveyor system of the invention, including the heat exchange zone thereof.

Referring to FIG. 1, a conveyor/heat exchanger system 10 is illustrated schematically. System 10 includes an elongated heat exchange zone 12 later to be described in detail, a raw shale loading zone 14, a spent shale disposal area 16, a preheated shale collection zone 18, a hot, spent shale loading area 20, and an endless conveyor 22 extending between the above described zones and areas. As noted above, system 10 is particularly adapted for use in conjunction with the methods described in U.S. Pat. No. 4,088,562.

During the operation of system 10, raw shale rock from a mine or other source is loaded onto the conveyor 22 at the zone 14. This raw shale then passes through the heat exchange zone 12 and is heated therein by hot, spent shale from the process (which is loaded onto conveyor 22 at the area 20). Thus, in the exchange zone 12, raw, cold shale and hot, spent shale are passed for thermal interchange such that the raw shale is preheated (preferably to about 450° F.), whereas the spent shale is cooled to facilitate disposal thereof. The cooled spent shale then passes to the area 16 for ultimate disposal, whereas the preheated shale goes to a holding area for ultimate transfer to the reactor or reactors of the process. The system 10 in the depicted embodiment is partially subterranean, with the heat exchange zone 12 and loading zone 14 being above grade line 24, whereas the remaining components of the system are below grade.

Inasmuch as the structure described herein is particularly adapted for (but not limited to) use with the methods described in U.S. Pat. No. 4,088,562, the latter patent is expressly incorporated by reference herein.

Figure 6:
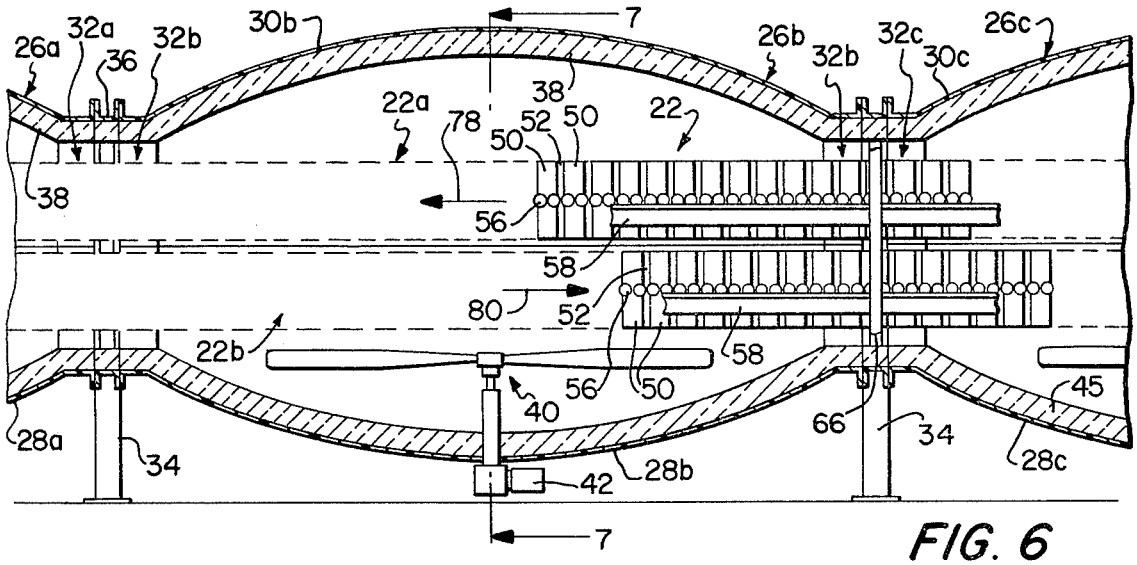
FIG. 6 is a fragmentary longitudinal vertical section of three interconnected heat exchange modules forming a part of the heat exchange zone.
Figure 7:
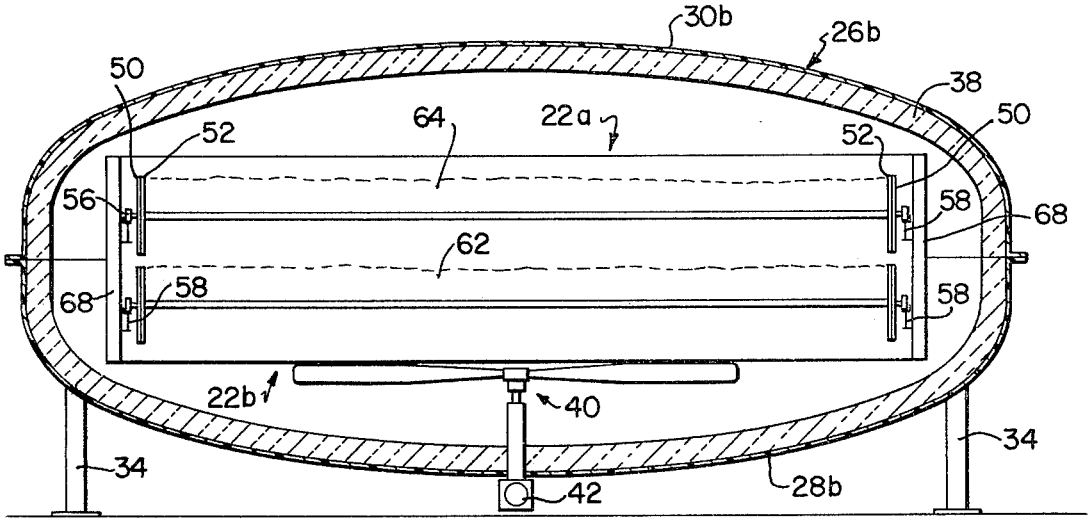
FIG. 7 is a sectional view taken along line 7—7 of FIG. 6 which further depicts the construction of the heat exchange modules.

Heat exchange zone 12 is comprised of a plurality of separate, interconnected pods or modules 26 which cooperatively present an elongated zone. As best seen in FIGS. 6 and 7, the modules 26 (denominated 26*a*, 26*b*, and 26*c* in FIG. 6 to facilitate description) each include a base section 28, and a lid section 30 which is hingedly secured to the base. In addition, at the opposed ends of each module 26, a restricted outlet or throat 32 is provided. At the area of the respective throats 32, the modules are interconnected and supported by means of support struts 34 and flanged connectors 36.

The base sections and lids of the modules 26 are preferably formed of cast fiberglass for ease of fabrication and reasons of cost. Of course, other materials could be used in this context. Moreover, the entirety of the modules are preferably thermally insulated by means of conventional insulation 38. The central region of each module 26 houses respective conveyor sections 22*a*, 22*b*. As best seen in FIG. 7, these sections are in spaced, adjacent, superposed relationship and move in opposite directions through the exchange zone 12.

Each module 26 also includes a slow moving fan 40 disposed centrally within the module below conveyor section 22*b*. The fans 40 are of conventional construction and are powered by motor means 42. The purpose of the fans is to move air currents between the conveyor sections 22*b* and 22*a* as will be more fully described.

Figure 4:
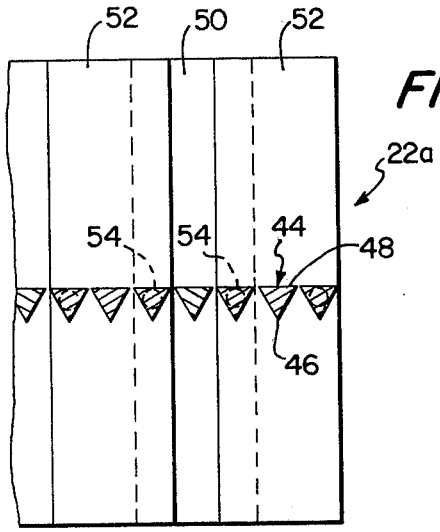
FIG. 4 is a sectional view taken along line 4—4 of FIG. 2.
Figure 5:
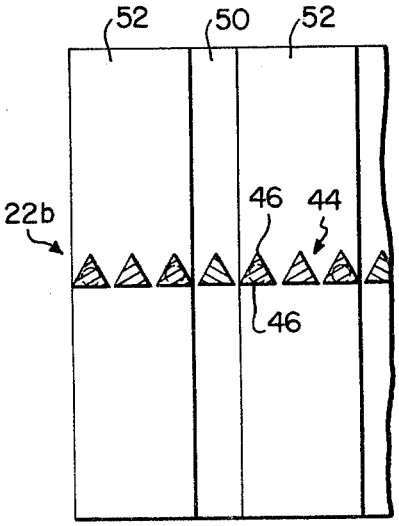
FIG. 5 is a view similar to that of FIG. 4, but illustrating the shale-supporting triangular elements in their inverted position for supporting hot, spent shale in the heat exchange zone.
Figure 3:
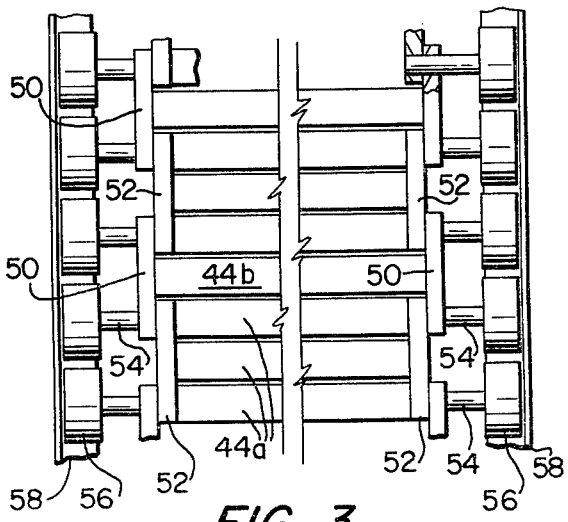
FIG. 3 is a fragmentary plan view of the conveyor illustrated in FIG. 2.

Conveyor 22 is endless and includes a plurality of spaced, juxtaposed, transversely extending, shale-supporting elements 44 each presenting an elongated pointed apex 46 and an opposed, elongated flat stretch 48 (see FIGS. 4 and 5). The elements 44 are interconnected by means of a series of alternating side plates 50, 52 disposed on opposite ends of the elements and coupled to the same. As best seen in FIG. 3, each pair of inner plates 52 support three juxtaposed elements 44*a*, whereas each pair of outer plates 50 support a somewhat longer element 44*b* located between the sets of plates 44*a*. The plates are interconnected by means of elongated shafts 54 which extend through the inner and outer plates 50, 52 as illustrated. Rollers 56 are journaled onto the outermost ends of the shafts 54, and the rollers 56 in turn are supported by and ride on conventional tracks 58. It will be appreciated in this regard that the elements 44, plates 50, 52 and rollers 56 are appropriately rotationally interconnected in order to permit the conveyor 22 to traverse bends and corners.

Figure 2:
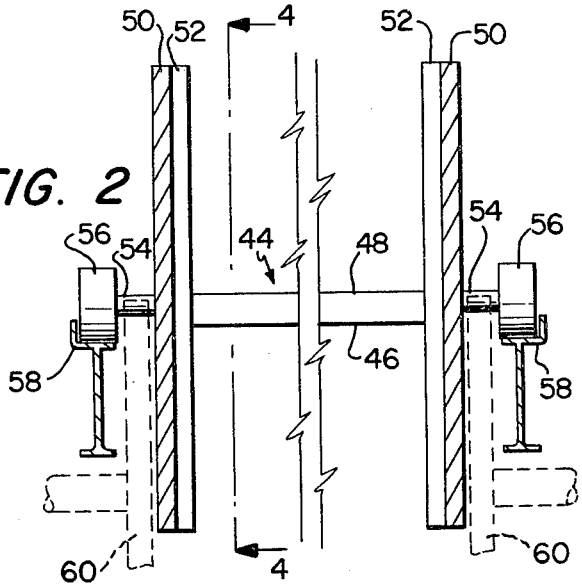
FIG. 2 is a fragmentary, vertical cross-sectional view illustrating the construction of the conveyor of the invention, with drive sprockets for the conveyor being illustrated in phantom.
Figure 8:
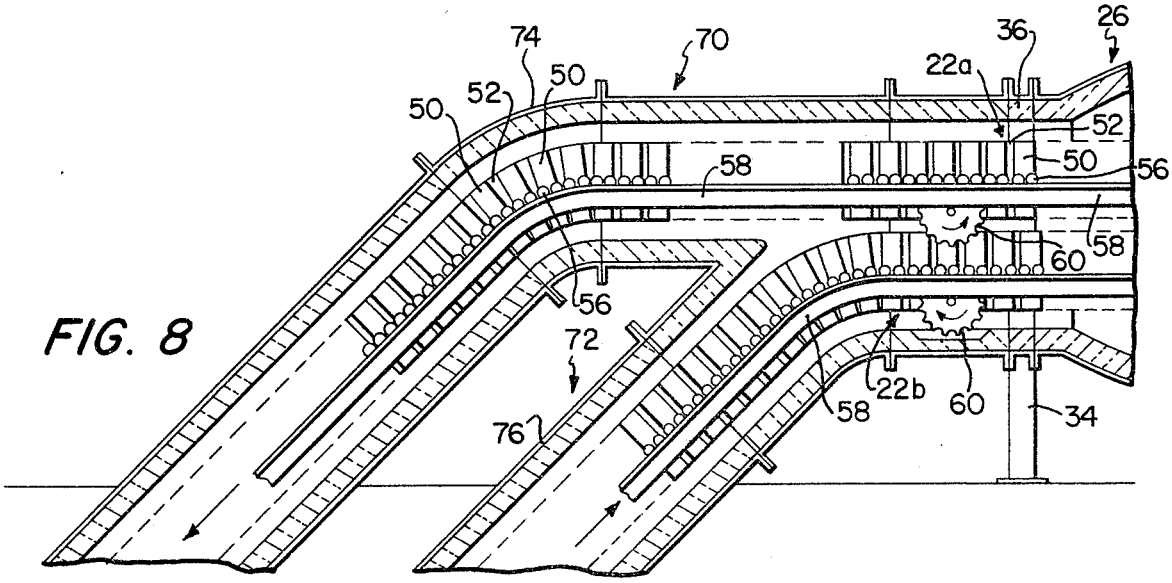
FIG. 8 is a fragmentary vertical section illustrating one end of the heat exchange zone where the conveyor sections separate.

Drive means is provided for the conveyor 22 in the form of a series of drive sprockets 60 located for operatively engaging the respective shafts 54 (see FIGS. 2 and 8). The sprockets 60 are driven by conventional means, and an appropriate number of such drive units are provided as will be readily understood.

The plates 50, 52 extend a substantial distance both above and below the elements 44, in order to define shale-confining sidewalls for the conveyor 22. As best seen in FIG. 7, quantities of hot, spent shale 62 and raw, incoming shale 64 are respectively supported in zone 12 by the sections 22*b*, 22*a* and are maintained and confined by the interconnected plates 50, 52. Of course, the shale quantities are likewise supported and confined outside of zone 12.

The conveyor sections 22*a*, 22*b* are supported within heat exchange zone 12 by means of conventional supports 66 located within the restricted openings defined by the throats of interconnected modules 26. Elongated side rails 68 extend between the supports 66 and along the length of zone 12; and the tracks 58 extending through the zone 12 are in turn operatively secured to the rails 68 (see FIG. 7).

The conveyor structure adjacent the left hand end of zone 12 is illustrated in detail in FIG. 8. As will be seen, conveyor 22 splits in this area into two legs 70, 72. Inasmuch as each of the legs carry hot shale (the leg 70 carrying preheated shale to the process, while the leg 72 carries hot, spent shale from the process), conventional, thermally insulated tunnel structure 74 and 76 surrounds the respective conveyor legs. Of course, at the collection zone 18 and loading area 20, the tunnel structure is conventionally modified so as to permit transfer of shale off of and onto the conveyor 22. The conveyor adjacent the right hand end of zone 12 likewise splits as seen in FIG. 1, and is structured as depicted in FIG. 8; in this instance however, no thermal insulation is required because only cold or cooled shale is being handled.

Referring again to FIG. 8, it will be seen that both legs 70, 72 turn downwardly from the elevation of heat exchange zone 12. Accordingly, the tracks 58 at these turndown areas are correspondingly curved. This presents no problem to movement of conveyor 22 however, by virtue of the fact that the plate and roller arrangement described can pivot as seen in FIG. 8 to follow the contour of the arcuate track regions.

In FIG. 4 the disposition of the elements 44 in upper conveyor section 22*a* is depicted. That is to say, in this upper section the elements 44 are oriented such that the stretches 48 are uppermost, and the apices 46 lie therebelow. This situation is reversed however in the lower conveyor section 22*b* (see FIG. 5). In this section, the apices 46 are uppermost, whereas the stretches 46 are below. In either case though, it will be observed that the elements can adequately support the shale and the plates 50, 52 serve as effective sidewalls for the shale.

In some instances it may be desirable to include spaced mixing fingers or the like for intermittently churning and mixing of the shale in the zone 12. This would improve the heat exchange efficiency of the apparatus, and prevent self-insulation in the shale piles.

In the operation of system 10, spent shale from a reactor is deposited onto conveyor 22 at loading area 20. This shale would characteristically be at a temperature of up to 1000° F. At the same time, raw, cold shale is deposited onto conveyor 22 at zone 14. These separate quantities of shale are then passed in countercurrent relationship through the zone 12, as best illustrated by the arrows 78, 80 of FIG. 6. In the zone 12, a heat exchange occurs between the hot and cold shale, and the initially cold shale exists therefrom at a temperature of about 450° F., whereas the initially hot, spent shale is cooled. Such heat exchange is greatly facilitated by means of the fans 40 which serve to direct air currents upwardly through the respective modules 26. Such air passes through the hot shale supported on the conveyor section 22*b*, and thence upwardly through the initially cold shale on the section 22*a*. It will be observed in this connection that the spacing between the elements 44 in the sections 22*b*, 22*a* permits such gas flow, while preventing substantial passage of the shale itself therethrough.

Subsequent to the heat exchange step, the preheated shale in the conveyor leg 74 passes to the zone 18 where it is dumped into a holding vessel 82 prior to transfer to a shale reactor. The conveyor then passes down through the system until the area 20 is reached (at which point the elements 44 are inverted as illustrated in FIG. 5) and hot spent shale from the process is picked up. Such shale is ultimately passed through zone 12 for preheating of fresh quantities of shale.

The cooled spent shale exiting from the right hand end of zone 12 as illustrated in FIG. 1 passes by gravity feed to disposal area 16, whereupon the conveyor 20 passes around the latter and up to the zone 14 (at which point the elements 44 again assume the position illustrated in FIG. 4). Thus, a single endless conveyor is employed for shale pickup and delivery, and a portion of the path of travel of the conveyor presents a heat exchange zone wherein respective, oppositely moving sections are disposed in spaced, adjacent, superposed relationship for exchange of heat.

Among the many advantages of the system and structure herein described is the fact that characteristic chimney-like currents or drafts are minimized or completely avoided. That is to say, it is common in elongated tunnel-type heat exchangers to experience drafts along the length thereof. However, provision of the fans 40 which serve to create air currents transverse to the longitudinal axis of the overall zone minimizes this tendency. In addition, the restricted throats of the separate modules 26 serve to dampen chimney drafts. Should further steps need to be taken to prevent such drafts, it would be possible to suspend air-deflecting curtains or the like within the modules 26.

It will further be appreciated that use of separate, interconnected modules 26 greatly facilitates repair and/or replacement thereof, in the event that such is needed. Furthermore, the fact that the lids of the separate modules can be opened permits selective access to the conveyor structure within the zone 12 all along the length thereof.

It will thus be seen that the present invention provides a greatly improved conveyor/heat exchanger apparatus for use in large scale commercial shale oil recovery plants, particularly of the type described in U.S. Pat. No. 4,088,562. Of course, those skilled in the art will understand that the system of the invention has wide applicability in other processes.

Having thus described the invention, what is claimed as new and desired to be secured by Letters Patent is:

1. Heat exchange apparatus, comprising:

means for supporting a relatively cold first material to be heated;

structure for supporting a relatively hot second material adjacent said cold material; and an elongated, tunnel-like heat exchanger disposed about and receiving said means and said structure for permitting heat exchange between said first and second materials, said heat exchanger including a plurality of zones along the length thereof, each of said zones being defined by walls which present an inlet and an outlet, and a central heat exchanger region between said inlet and said outlet, the maximum cross-sectional area of said central region being substantially larger than the cross-sectional areas of said inlet and said outlet, for defining, along the length of spaced, restricted throats serving to said heat exchanger, a plurality of dampen chimney-like drafts along the length of said heat exchanger.

2. Apparatus as set forth in claim 1 including fan means communicating with said regions for moving air currents between said hot and cold material for enhancing thermal interchange therebetween.

3. Apparatus as set forth in claim 1 wherein said means and said structure each comprise an elongated, material-supporting conveyor section for moving said first and second materials through said modules.

4. Apparatus as set forth in claim 3 including means mounting said sections in spaced, superposed relationship, with the section supporting said hot material being beneath the section supporting said cold material.

5. Apparatus as set forth in claim 4 wherein said conveyor sections include a plurality of elongated, spaced, juxtaposed, interconnected material-supporting elements located with the longitudinal axes thereof transverse to the longitudinal axis of said zone.

6. Apparatus as set forth in claim 5 wherein said elements are of triangular cross-section.

7. Apparatus as set forth in claim 6 wherein the elements of the upper section are oriented to present uppermost side-by-side flat stretches with pointed apices therebelow, and the elements of said lower section are oriented to present uppermost pointed apices and flat stretches therebeneath.

8. Apparatus as set forth in claim 1, said zone-defining walls presenting respective heat exchange modules.

9. Apparatus as set forth in claim 8 wherein each of said modules comprises a base section, and a lid section hingedly secured to the base section.

* * * * *

UNITED STATES PATENT AND TRADEMARK OFFICE

CERTIFICATE OF CORRECTION

PATENT NO. : 4,260,371

DATED : April 7, 1981

INVENTOR(S) : Joseph M. O'ffill

It is certified that error appears in the above-identified patent and that said Letters Patent are hereby corrected as shown below:

Column 6, lines 17-20, inclusive, (Claim 1) should read --ing, along the length of said heat exchanger, a plurality of spaced, restricted throats serving to dampen chimney-like drafts along the length of said heat exchanger.--

Signed and Sealed this

*Twenty-seventh* Day of *October 1981*

[SEAL]

*Attest:*

GERALD J. MOSSINGHOFF

*Attesting Officer*

*Commissioner of Patents and Trademarks*